US009248337B1

(12) United States Patent
Humphrey

(10) Patent No.: US 9,248,337 B1
(45) Date of Patent: Feb. 2, 2016

(54) LIFT ADVANTAGE WEIGHT LIFTING BENCH APPARATUS

(71) Applicant: Damon Joseph Humphrey, San Diego, CA (US)

(72) Inventor: Damon Joseph Humphrey, San Diego, CA (US)

( * ) Notice: Subject to any disclaimer, the term of this patent is extended or adjusted under 35 U.S.C. 154(b) by 17 days.

(21) Appl. No.: 14/464,600

(22) Filed: Aug. 20, 2014

(51) Int. Cl.
*A63B 21/078* (2006.01)
*A63B 21/00* (2006.01)

(52) U.S. Cl.
CPC ..... *A63B 21/1457* (2013.01); *A63B 21/078* (2013.01); *A63B 2021/0783* (2013.01)

(58) Field of Classification Search
CPC ..... A63B 21/1457; A63B 21/078; A63B 21/00058; A63B 21/00178; A63B 21/022; A63B 21/023; A63B 21/0783; A63B 21/08; A63B 21/40; A63B 21/4005; A63B 21/4023; A63B 21/4027; A63B 21/4029; A63B 21/4031; A63B 22/0002; A63B 22/0015; A63B 22/0046; A63B 22/0087; A63B 23/035; A63B 23/12; A63B 23/1209; A63B 23/1281; A63B 21/0007; A63B 21/081; A63B 21/0004; A63B 21/00047; A63B 21/00181; A63B 21/072; A63B 21/0724; A63B 21/0726; A63B 21/0728; A63B 21/075; A63B 23/1254
See application file for complete search history.

(56) References Cited

U.S. PATENT DOCUMENTS 3,524,644 A * 8/1970 Kane ..... A63B 21/023 482/129
3,640,529 A * 2/1972 Kane ..... A63B 21/023 482/129
3,874,658 A 4/1975 Flowers
4,256,301 A 3/1981 Goyette
4,471,956 A 9/1984 Mario
4,635,930 A 1/1987 Cormier
4,650,186 A 3/1987 McCreery et al.
4,949,959 A 8/1990 Stevens
5,125,881 A * 6/1992 Jones ..... A63B 21/0615 482/100
5,190,510 A 3/1993 Goodger
6,746,379 B1 6/2004 Brawner
6,926,648 B2 8/2005 Capizzo
7,585,259 B2 9/2009 Turner
2004/0162200 A1 8/2004 Brawner
2005/0277524 A1 12/2005 Bae
2010/0130335 A1 5/2010 Hoobler
2015/0224359 A1 * 8/2015 Kalleen ..... A63B 21/00047 482/104

* cited by examiner

*Primary Examiner* — Oren Ginsberg
*Assistant Examiner* — Megan Anderson
(74) *Attorney, Agent, or Firm* — Williams Intellectual Property; Benjamin F. Williams

(57) ABSTRACT

A lift assist weight lifting bench that includes a pair of arm assists disposed connected to a pair of strut member laterally projected from a weight lifting bench proper, in position appropriate for each arm assist to supportively underlie and contact the dorsal side of each of a user's upper arms, whereby a spring member, disposed compressibly connected between each arm assist and each strut member, compresses when each arm assist is moved to a lowered position, by action of a user lowering a weight, each spring member then decompressing when each arm assist is moved to a raised position when said user raises the weight, whereby elastic force exerted by said spring members engages each arm assist to the dorsal side of each of a user's upper arms and thereby assists in lifting the weight without the use of pulleys or another person standing as spotter.

6 Claims, 2 Drawing Sheets

LIFT ADVANTAGE WEIGHT LIFTING BENCH APPARATUS

BACKGROUND OF THE INVENTION

Various types of lift assist weight lifting apparatuses are known in the prior art. Most involve complex arrangements of pulleys disposed to prevent collapse of a user's arms while bench pressing. What is needed, though, is a lift advantage weight lifting bench apparatus that includes a pair of arm assists disposed connected to a pair of strut members laterally projected from a weight lifting bench proper, in position appropriate for each arm assist to supportively underlie and contact the dorsal side of each of a user's upper arms, whereby a spring member, disposed compressibly connected between each arm assist and each strut member, compresses when each arm assist is moved to a lowered position, by action of a user lowering a weight, each spring member thence decompressing when each arm assist is moved to a raised position when said user raises the weight, whereby elastic force exerted by said spring members engages each arm assist to the dorsal side of each of a user's upper arms and thereby assists the user lifting the weight without the use of pulleys or another person standing as spotter.

FIELD OF THE INVENTION

The present invention relates to a lift assist weight lifting bench, and more particularly, to a lift assist weight lifting bench that includes a pair of arm assists disposed connected to a pair of strut member laterally projected from a weight lifting bench proper, in position appropriate for each arm assist to supportively underlie and contact the dorsal side of each of a user's upper arms, whereby a spring member, disposed compressibly connected between each arm assist and each strut member, compresses when each arm assist is moved to a lowered position, by action of a user lowering a weight, each spring member thence decompressing when each arm assist is moved to a raised position when said user raises the weight, whereby elastic force exerted by said spring members engages each arm assist to the dorsal side of each of a user's upper arms and thereby assists in lifting the weight.

SUMMARY OF THE INVENTION

The general purpose of the lift assist weight lifting bench, described subsequently in greater detail, is to provide a lift advantage weight lifting bench apparatus which has many novel features that result in a lift advantage weight lifting bench apparatus which is not anticipated, rendered obvious, suggested, or even implied by prior art, either alone or in combination thereof.

The present lift advantage weight lifting bench apparatus has been devised to enable assisted lifting of weights during bench presses by action of spring members, disposed between each of a pair of arm assists and each of a pair of strut members laterally projected on either side of a weight lifting bench without the need of pulleys, said spring members compressibly disposed to exert elastic force in the direction of a lifted weight.

The present lift advantage weight lifting bench apparatus, therefore, includes a weight lifting bench dispositional underlying a weight support, in the manner seen in the bench pressing arts. A user lays supine upon the bench, to rest said user's upper arms upon each of a pair of arm assists—padded members disposed to underlie and conjunct the dorsal side of each of said user's upper arms when said user adopts a posture appropriate for bench pressing an overlying weight.

Each arm assist is connected to a strut member, said strut member disposed laterally projected from either side of the weight lifting bench. A spring member is compressibly disposed between each strut member and each arm assist, whereby said spring member is compressibly engaged when each corresponding arm assist is moved to a lowered position. Movement of each arm assist to a raised position is thus assisted by the elastic force exerted by the associated spring member when said spring member decompresses. Each arm assist, therefore, raises conjunct the dorsal side of a user's upper arm wherein the elastic force applied by each spring member aids in lifting a weight to an uppermost position absent the need of pulleys or a second person standing as spotter.

Thus has been broadly outlined the more important features of the present lift advantage weight lifting bench apparatus so that the detailed description thereof that follows may be better understood and in order that the present contribution to the art may be better appreciated.

Objects of the present lift assist weight lifting bench, along with various novel features that characterize the invention are particularly pointed out in the claims forming a part of this disclosure. For better understanding of the lift assist weight lifting bench, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
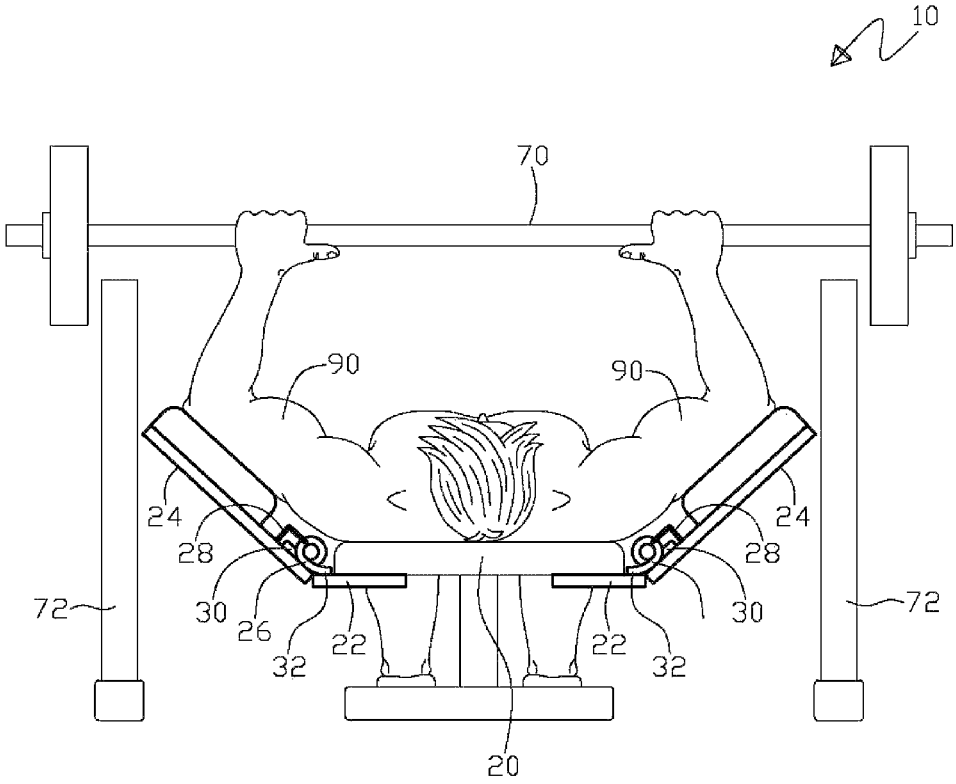
FIG. 1 is a top view of an embodiment.
Figure 2:
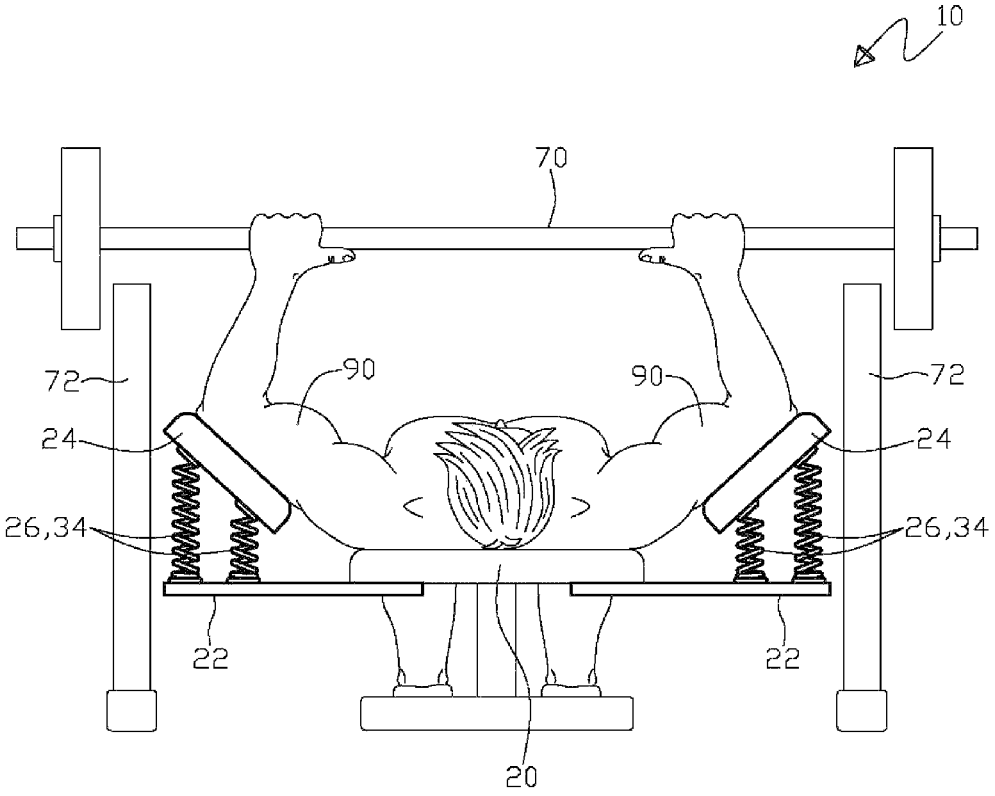
FIG. 2 is a top view of an embodiment.

With reference now to the drawings, and in particular FIGS. 1 through 2 thereof, example of the instant lift advantage weight lifting bench apparatus employing the principles and concepts of the present lift advantage weight lifting bench apparatus and generally designated by the reference number 10 will be described.

Referring to FIGS. 1 through 2 a preferred embodiment of the present lift advantage weight lifting bench apparatus 10 is illustrated.

The present lift advantage weight lifting bench apparatus 10 has been devised to enable assisted lifting of weights 70 during bench presses without the need of pulleys or a second person acting as a spotter. The present lift advantage weight lifting bench apparatus 10 comprises a spring member 26 compressibly disposed between each of a pair of arm assists 24 and each of a pair strut members 22, said arm assists 24 and strut members 22 disposed laterally projected on either side of a weight lifting bench 20 in position to engage each of said arm assists 24 against the dorsal side of each of a user's upper arms 90 when said user lies supine upon the bench 20, whereby the elastic force exerted by decompression of said spring members 26 raises each arm assist 24 in conjunction with the upper arms 90 of a user laying supine upon the weight lifting bench 20, thereby aiding lifting a weight 70 during a bench press.

Each spring member 26 is contemplated to be tensional whereby the elastic force exerted during decompression of said spring members 26 is adjustable. A user may, therefore, adjust the amount of assistance rendered when bench pressing a weight 70 between a maximum assistance elastic force and a minimum assistance elastic force.

The present lift advantage weight lifting bench apparatus 10, therefore, includes a weight lifting bench 20 dispositional proximal a weight support 72, as seen in the present state of the art, wherein bench pressing variable weight 70 is effective. Each of pair of strut members 22, however, is disposed laterally projected from an underside of said bench 20, each of said pair of strut members 22 disposed in a position to underlie the shoulders of a supine user disposed atop the bench 20. Each of a pair of arm assists 24 is hingedly attached endwise upon each of the pair of strut members 22, likewise in position to underlie and contact a dorsal side of each of an upper arm 90 of a supine user laying upon the bench 20.

Each of said pair of arm assists 24 is disposed engageable against a spring member 26, said spring member 26 disposed compressible between the associated arm assist 24 and strut member 22, when each of said pair of arm assists 24 is moved between a lowered position and a raised position. Each spring member 26 is compressed when each arm assist 24 is moved to the lowered position, as when a user lowers a weight 70 and engages the dorsal side of each upper arm 90 against each arm assist 24, forcing said arm assists 24 into the lowered position, whereat contact with the dorsal side of each upper arm 90 of said user positions a weight 70 held by the user at a lowermost extremity.

Subsequent lifting of the weight 70 thence effects decompression of each spring member 26. Each spring member 26 therefore exerts elastic force against the dorsal side of each of said user's upper arms 90, whereby additional force is applicable to assist in raising the weight 70 to an uppermost extremity.

It is contemplated as part of this invention 10 that each spring member 26 is tensional in position by action of a compression member 28. The compression member 28 is contemplated to tension each spring member 26 between a maximum tension and a minimum tension, whereby decompression of each spring member 26 is limitable within a minimum decompression and a maximum decompression respectively. Thus the amount of elastic force exerted during decompression of each of said spring members 26 is adjustable, as desired, to render more or respectively less assistance during bench presses.

Thus the present invention 10 enables assisted lifting during bench presses without the need of a second person acting as a spotter, each of said arm assists 24 acting to provide additional uplift during raising of a weight 70, whereby a user is more easily enabled to return the weight 70 to the weight support 72 between repetitions.

A first embodiment of the present lift advantage weight lifting bench apparatus 10 is illustrated in FIG. 1. Each spring member 26 herein is disposed coiled with a first end 30 connected to the associated arm assist 24 and a second end 32 connected to the associated strut member 22. Compression of the spring member 26 thus results by rotation of the spring coil proper, when the associated arm assist 24 is moved to the lowered position. Decompression thence releases the elastic force potentiated during rotation of the spring coil when the arm assist 24 is moved to the raised position.

A second embodiment of the present lift assist weight lifting apparatus 10 is illustrated in FIG. 2. In this embodiment, each spring member 26 includes a plurality of springs 34 disposed endwise between the associated strut member 22 and arm assist 24. In this embodiment compression of the spring member 26 results by application of compressive force along a longitudinal axis relative each of the plurality of springs 34, whereby each of the plurality of springs 34 is compressed endwise when each arm assist 24 is moved to the lowered position.

In this second embodiment, each strut member 24 is elongated relative the length of the strut members 24 of the first embodiment, each strut member 24 here disposed to provide a base underlying each arm assist 26 against which to compress each of the plurality of springs 34 endwise thereon. Each arm assist 24 is not necessarily hingedly attached to the associated strut member 26 in contemplation of this embodiment, but is assisted to return to the raised position by decompression of each of said plurality of springs 34 extending along a longitudinal axis relative each of said springs 34.

What is claimed is:

1. A lift advantage weight lifting bench apparatus comprising:

a weight lifting bench;

a pair of strut members disposed laterally projected from an underside of said bench, each of said pair of strut members disposed in a position to underlie a pair of shoulders of a supine user atop the bench; and a pair of arm assists, each of the arm assists attached to one of the pair of strut members in position to underlie each of an upper arm of the supine user laying upon the bench, each of said pair of arm assists disposed against action of a spring member compressible between the associated arm assist and strut member when each of said pair of arm assists is moved between a lowered position and a raised position;

wherein movement of each of the arm assists to the lowered position compresses the associated spring member and movement of each of the arm assists to the raised position decompresses the associated spring member whereby the elastic force applied decompressing each of the spring members assists lifting of a weight hefted by the user laying supine upon the bench.

2. The lift advantage weight lifting bench apparatus of claim 1 wherein each of the spring members are tensional by action of a compression member whereby the elastic force exerted during decompression of each of said spring members is adjustable.

3. A lift advantage weight lifting bench apparatus comprising:

a weight lifting bench;

a pair of strut members disposed laterally projected from an underside of said bench, each of said pair of strut members disposed in a position to underlie a pair of shoulders of a supine user atop the bench;

a padded pair of arm assists, each one of the pair of arm assists attached to one of the pair of strut members in position to underlie each of an upper arm of the supine user laying upon the bench; and a pair of spring members, wherein each of the pair of spring members is connecting each arm assist to each strut member, each of said spring members disposed along a transverse plane relative the associated arm assist and strut member, each of said spring members comprising:

a first end laterally connected to a respective one of said arm assists;

a second end laterally connected to a respective one of said strut members;

wherein movement of each of the arm assists to the lowered position compresses the associated spring member by rotary action applied to coil said spring member around a central axis, and movement of each of the arm assists to the raised position decompresses the associated spring member applied to uncoil said spring member around said central axis, whereby the elastic force applied decompressing each spring member assists lifting of a weight hefted by the user laying supine upon the bench.

4. A lift advantage weight lifting bench apparatus comprising:

a weight lifting bench;

a pair of strut members disposed laterally projected from an underside of said bench, each of said pair of strut members disposed in a position to underlie a dorsal side of an upper arm of a supine user laying atop the bench;

a padded pair of arm assists, each one of the pair of arm assists attached to one of the pair of strut members, each of said padded pair of arm assists disposed in position to underlie each of an upper arm of the supine user laying upon the bench; and a pair of spring members disposed in between each of the arm assists and strut members connecting each of the arm assists to each of the strut members, each of said spring members disposed for endwise compression therebetween, each of said spring members comprising:

a first end connected endwise to a respective one of said arm assists;

a second end connected endwise to a respective one of said strut members;

wherein movement of each of the arm assists to the lowered position compresses the associated spring member by downward action applied to said spring member along a longitudinal axis, and movement of each of the arm assists to the raised position decompresses the associated spring member by upward action applied to said spring member along the longitudinal axis, whereby the elastic force applied decompressing each of the spring members assists lifting of a weight hefted by the user laying supine upon the bench.

5. The lift advantage weight lifting bench apparatus of claim 3 wherein each of the spring members are tensional by action of a compression member whereby the elastic force exerted during decompression of each of said spring members is adjustable.

6. The lift advantage weight lifting bench apparatus of claim 4 wherein each of the spring members are tensional by action of a compression member whereby the elastic force exerted during decompression of each of said spring members is adjustable.

* * * * *